US007204919B2

(12) United States Patent
Dufresne

(10) Patent No.: US 7,204,919 B2
(45) Date of Patent: Apr. 17, 2007

(54) CAPPING BOARD WITH AT LEAST ONE SHEET OF ELECTRICALLY CONDUCTIVE MATERIAL EMBEDDED THEREIN

(75) Inventor: Robert P. Dufresne, St-Bruno (CA)

(73) Assignee: Pultrusion Technique Inc., St-Bruno, Québec (CA)

( * ) Notice: Subject to any disclaimer, the term of this patent is extended or adjusted under 35 U.S.C. 154(b) by 707 days.

(21) Appl. No.: 10/725,548

(22) Filed: Dec. 3, 2003

(65) Prior Publication Data

US 2005/0121319 A1 Jun. 9, 2005

(51) Int. Cl.
*C23B 9/04* (2006.01)

(52) U.S. Cl. ..... 204/279; 204/281; 204/286.1; 204/288.1; 204/288.2; 204/297.01; 204/267; 204/278.5

(58) Field of Classification Search ..... 204/279, 204/281, 286.1, 288.1, 288.2, 297.01, 267, 204/278.5

See application file for complete search history.

(56) References Cited

U.S. PATENT DOCUMENTS 3,682,809 A 8/1972 Marquardson et al.
3,697,404 A 10/1972 Paige
3,929,614 A * 12/1975 Hidohira ..... 204/242
4,213,842 A 7/1980 Dufresne
4,479,863 A * 10/1984 Honey et al. ..... 204/279
5,645,701 A 7/1997 Dufresne et al.
6,342,136 B1 1/2002 Virtanen et al.
2003/0066759 A1* 4/2003 Hardee et al. ..... 205/565

* cited by examiner

*Primary Examiner*—Bruce F. Bell
(74) *Attorney, Agent, or Firm*—Robic

(57) ABSTRACT

Disclosed is a capping board for use to support anodes and cathodes within adjacent electrolytic cells, which has a plurality of individual seats positioned in spaced apart relationship all along its length to receive and support hanging legs projecting from these anodes and cathodes. This capping board is improved in that it has at least one sheet or wire of electrically conductive material embedded therein. This sheet or wire extends over the length of the board and is shaped and positioned so that part of its extends externally within at least some of the seats so as to allow electrical contact of the legs of either the anodes or the cathodes and to allow fast dissipation of heat in the case of a short circuit.

19 Claims, 16 Drawing Sheets

CAPPING BOARD WITH AT LEAST ONE SHEET OF ELECTRICALLY CONDUCTIVE MATERIAL EMBEDDED THEREIN

BACKGROUND OF THE INVENTION

A) Field of the invention

The present invention relates to a capping board of improved structure, which comprises at least one sheet of electrically conductive material embedded therein.

B) Brief Description of the Prior Art

In the hydrometallurgical industry, it is of common practice to refine metal by electrolysis in electrolytic cells especially designed for this purpose. The metals to be refined are usually conventional metals like copper, zinc, nickel or cadmium, or precious metals like silver, platinum or gold, and others.

In the commonly used hydrometallurgical process, metal plates are used as anodes or cathodes or both. These metal plates weight several hundred pounds. Usually, the metal to be refined, or the metal used to carry the electric current, is in the form of plates of a given thickness, which are provided at their upper end with two laterally extending projections. Such projections facilitate gripping, handling and hanging of the plates on lateral sidewalls of the cells. They also facilitate other operations.

In use, the plates which as aforesaid can each weight several hundred pounds, are immersed into the cells in parallel relationship and are used as anodes, cathodes or both, depending on the affinity of the metal being refined.

In order to have the electrodes positioned at the exact place, it is of common practice to place a member, called "capping board", onto the top surface of each lateral sidewall of the cells. Such capping boards are used to position the plates with respect to each other. Some of them are also used as electric insulators between adjacent cells and/or each electrodes and/or the ground.

In practice, the capping boards are used not only as supports to position the electrodes, but also as supports to avoid damage to the masonry or concrete forming the lateral side walls of the cells during the insertion and removal of the heaving electrodes.

As examples of such capping boards and the way they can be manufactured, reference can be made to U.S. Pat. No. 4,213,842 issued on Jul. 22, 1980 and Canadian patent No. 1,102,737 issued on Jun. 9, 1981 both in the name of Jean L. DUFRESNE and to the U.S. Pat. No. 5,645,701 issued on Jul. 8, 1997 and Canadian laid-open patent application No. 2,171,412 filed on Mar. 8, 1996 both in the names of Jean L. DUFRESNE and the present inventor, namely, Robert P. DUFRESNE.

As other examples of such capping boards, reference can also be made to U.S. Pat. No. 3,697,404 issued on Oct. 10, 1972 to Peter M. PAIGE and to U.S. Pat. No. 6,342,136 issued on Jan. 29, 2002 to OUTOKUMPU OYJ.

Thus, as aforesaid, in order to electrodes of electrolytic cells at proper locations within the cells it is of common practice to use insulating capping boards which have the advantages of holding the electrodes at very precise positions while being in contact with at least one current supply contact bar or to be insulated from the same. Thus, the combined use of capping boards and current supply contact bars have the particularity of allowing insulation and distribution of electric current at the same time.

In practice, to achieve proper electrical contact with a contact bar or insulation from the same, the plates forming the electrodes are provided with support hanging legs externally projecting on their opposite upper ends.

In practice also, only one of the legs of each plate is intended to be in contact with a current supply contact bar. The other leg of the same plate thus has to be held onto the capping board in such a way as to be insulated. Thus, the capping board per se plays the role of an insulator and has, for this purpose, to be made of material that are insulating.

If such has proved to be sufficient, there are still some problems with the existing systems using of capping boards with one or more supply bars placed on their top surfaces.

One of these problems is due to short circuits occurring during the hydrometallurgical operation of the electrolysis or electro-winning process. Other problems are also due to poor repartition of the electric current density distribution.

As shown in the above mentioned U.S. Pat. Nos. 3,697,404 and 6,342,136, the contact bars which can be V-shaped, have sharp edges and/or corrugated surfaces that may wear the surface of the insulating capping board. Such may in time substantially decrease the lifetime of the capping board and causes short circuit.

When short circuits arise, the temperature of the metal plates forming the electrode increases. This increase of temperature is transmitted by the metal plates to the insulating capping-board, which, as aforesaid, are made of insulating organic material which are very weak to thermal resistance especially in view of high pressure created by the such heavy weight metal plates.

Independently of the above, the combination of this high temperature and pressure as it occurs in use in the hydrometallurgical process, actually creates deformation within the capping boards. Such deformation is unacceptable since it may generate short circuits that may propagate from one cell to another cell.

These short circuits may produce a refined metal with major impurity and defects that gives to the quality of the refined metal a poor quality to be rejected.

SUMMARY OF THE INVENTION

It has now been discovered that when at least one sheet of conductive material is embedded inside a capping board in such a way that this sheet forms a seat for all the legs of the plates that are not to be in contact with a supply bar or, alternatively, this sheet forms a seat for all the legs of the plates that are to be connected to an electric source and thus acts as a contact bar, then one may reduce the above problem of wearing while simultaneously providing rapid and fast dissipation of the heat that may be generated by a short circuit. The embedded sheet marks it possible for the capping board to withstand the thermo mechanical strength required to resist to the heavy weight of the metal plates even in the presence of high temperature created by the short circuit.

Thus, the present invention is concerned with an improved capping board for use to support anodes and cathodes within adjacent electrolytic cells, said capping board having a given length and comprising a plurality of individual seats positioned in spaced apart relationship all along said length to receive and support hanging legs projecting from said anodes and cathodes.

The improvement lies in that the capping board comprises at least one sheet of electrically conductive material embedded therein, said at least one sheet or wire extending over the length of the board and being shaped and positioned so that part of it extends externally within at least some of the seats so as to allow electrical contact of the legs of either the anodes or the cathodes.

Such an improvement allows fast dissipation of heat in the case of a short circuit. Such also allows better distribution of electric current density.

As may also be appreciated, the above mentioned problems encountered with the existing capping boards are solved when use is made of at least one embedded sheet or wire of conductive natural that acts as a conductor and reinforce the board from the abrasion caused by the legs of the metal plates used as electrodes. The sheet or wire also protects the capping board against any deformations due to a high thermo mechanical strength caused by an electrical short circuit.

Thus, the embedded sheets or wire that are so embedded act not only as a protection for the capping board but also as a reinforcing material for thermo mechanical strength retention and heat dissipation within the capping board.

The invention and its a advantages will be better understood upon reading the following non-restrictive description of two preferred embodiment thereof, made with reference to the accompanying drawings.

DETAILED DESCRIPTION OF THE INVENTION

Figure 1:
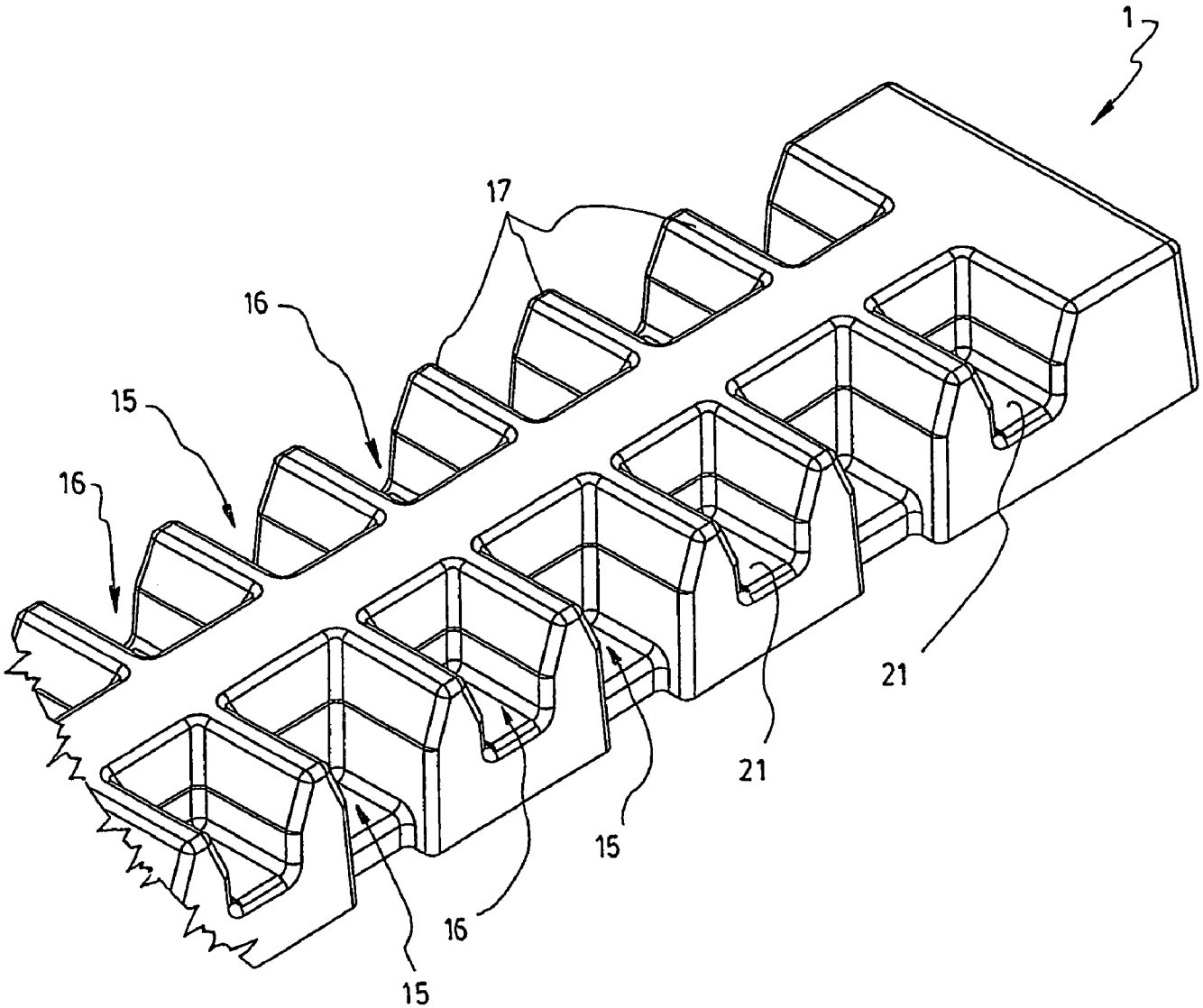
FIG. 1 is a perspective view of an end portion of an improved capping board according to a first preferred embodiment of the invention.
Figure 2:
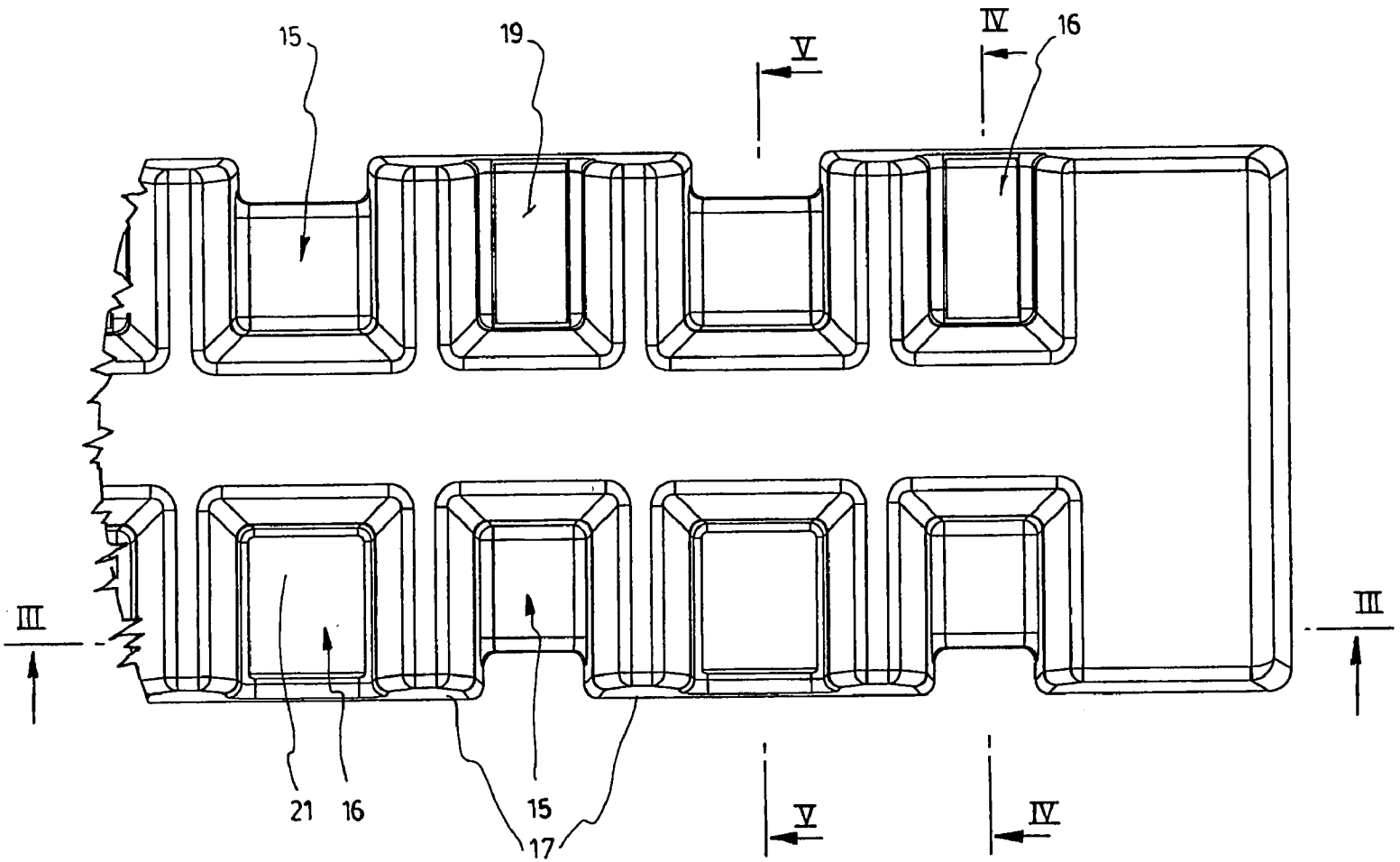
FIG. 2 is a top plan view of the end portion of the improved capping board shown in FIG. 1.
Figure 3:
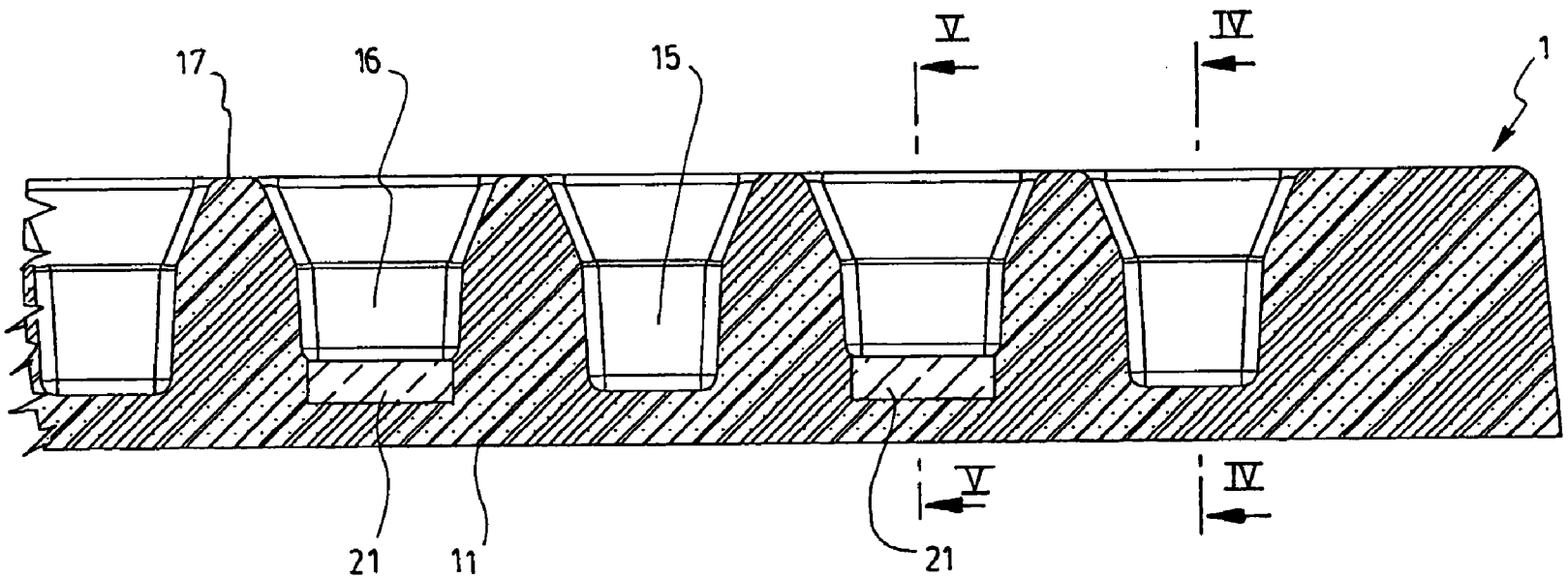
FIG. 3 is a side elevational, cross-sectional view of the end portion of the improved capping board sown in FIG. 1, taken along line III—III in FIG. 2.

Like all the existing capping boards, the improved capping board according to the invention as shown in the accompanying drawings, is intended to be used as a support for electrodes in an electrolytic cell. More particularly, it is intended to be positioned on the top surface of a lateral sidewall of a cell on which electrodes are hanged, in order to position them in precise layout alternation while simultaneously protecting this top surface from shocks occurring when handling the electrodes and while avoiding damage caused by the heavy weight of the electrodes.

More specifically, the capping board 1 according to the first preferred embodiment of the invention as shown in FIGS. 1 to 7 is intended to be used for supporting anodes 3 and cathodes 5 within adjacent electrolytic cells 7, 9. This capping board 1 comprises a main body of a given length having a bottom surface 11 shaped fit onto a contact bar located on top of the upper edges of the two adjacent cells 7, 9 (see FIGS. 4 and 5). The main body of capping board also has a top surface in which individual seats 15, 16 are made. As is shown, all the seats 15, 16 are in the form of recesses each forming a laterally opening compartment separated from the adjacent one by means of a vertical partition 17. All of the adjacent compartments extend in rows over all the length of the capping board on both sides of the main body.

As is also shown (see FIGS. 1, 4 and 5), the recesses forming the adjacent seats 15, 16 on each side of the main body are of two different depths, each recess 15 having one of said depth being adjacent to a recess 16 having the other one of said depths.

As aforesaid, the present invention essentially lies in that the above described capping board 1 comprises at least one sheet of electrically conductive material embedded therein, said least one sheet extending over the length of the board and being shaped and positioned so that part of it extends externally within at least some of the seats (those numbered 16 in the illustrated preferred embodiment) so as to allow electrical contact of the legs of either the anodes 5 or the cathodes 7 and to allow fast dissipation of heat in the case of a short circuit.

In the illustrated embodiment, the capping board 1 actually comprises two sheets 19, 21 of conductive material, preferably copper. One of these sheets, namely the one numbered 19, connects all the alternate insulating seats formed by the compartments 16 located on one side of the main body. The other one of the sheets, namely the one numbered 21, connect all the alternate insulating seats formed by the compartments 16 located on the other side of the main body.

Figure 4:
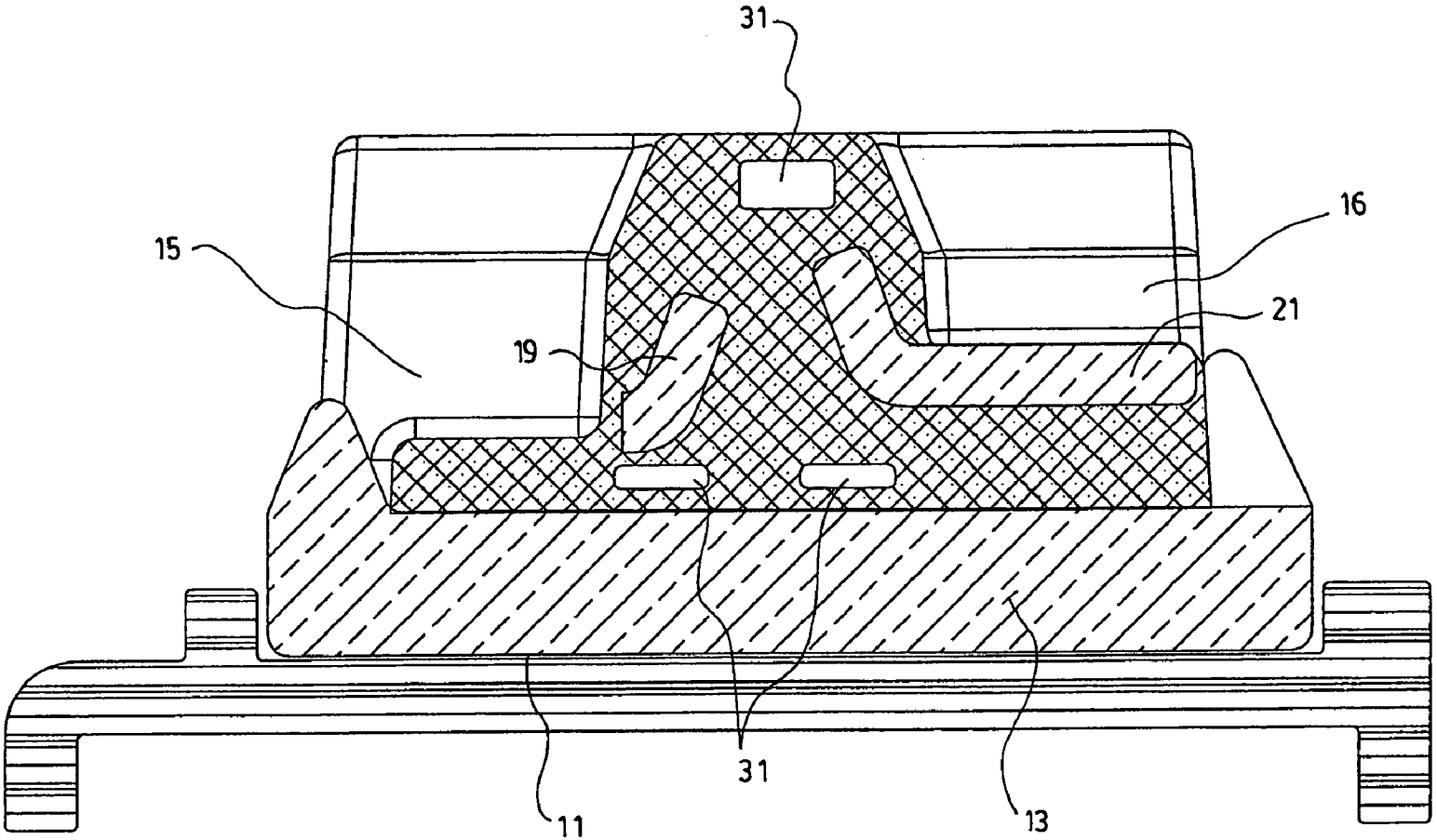
FIGS. 4 and 5 are cross-sectional views of the end portion of the improved capping board shown in FIG. 1, taken along lines IV—IV and V—V, respectively, in FIGS. 2 and 3.
Figure 5:
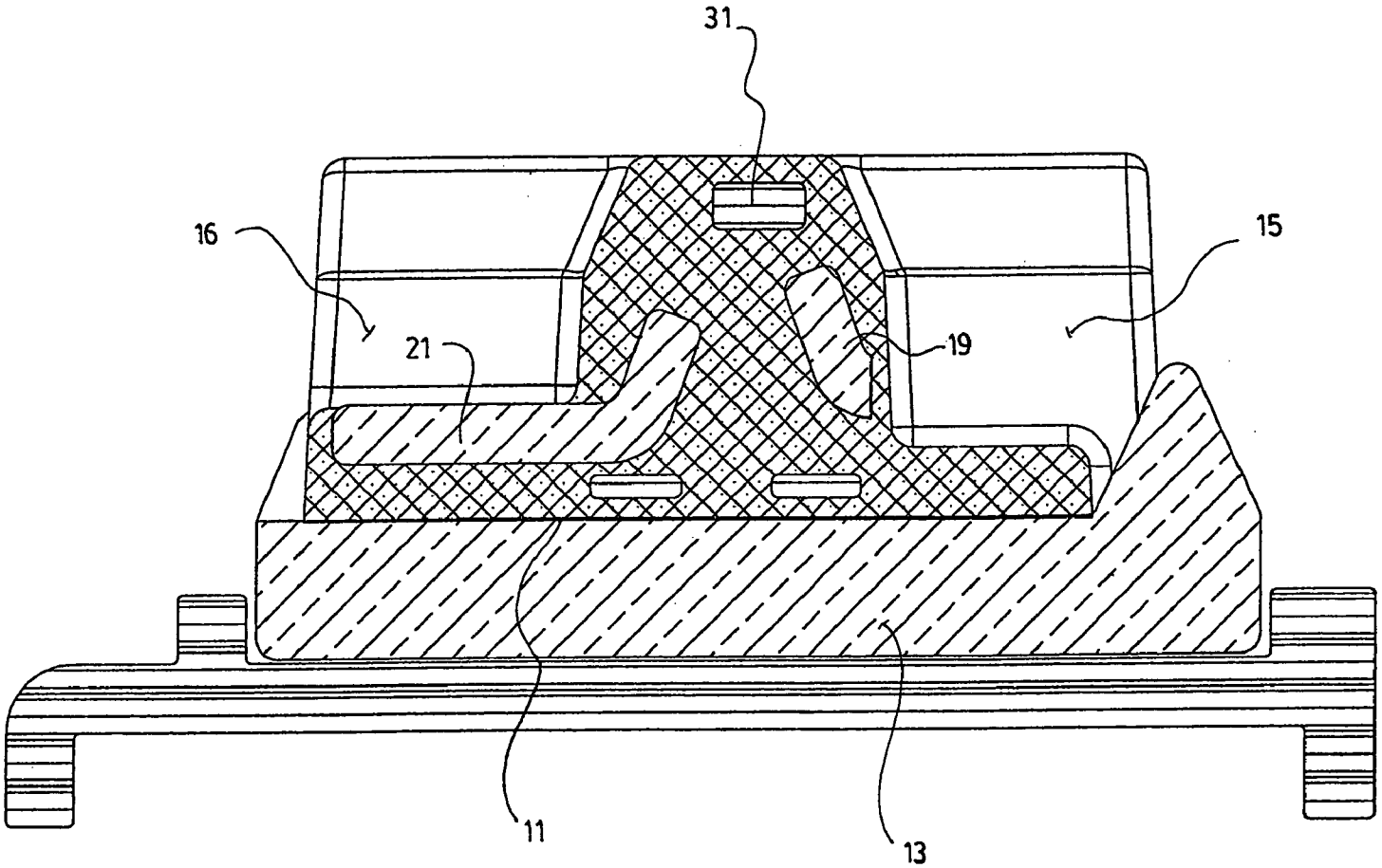
Figure 6:
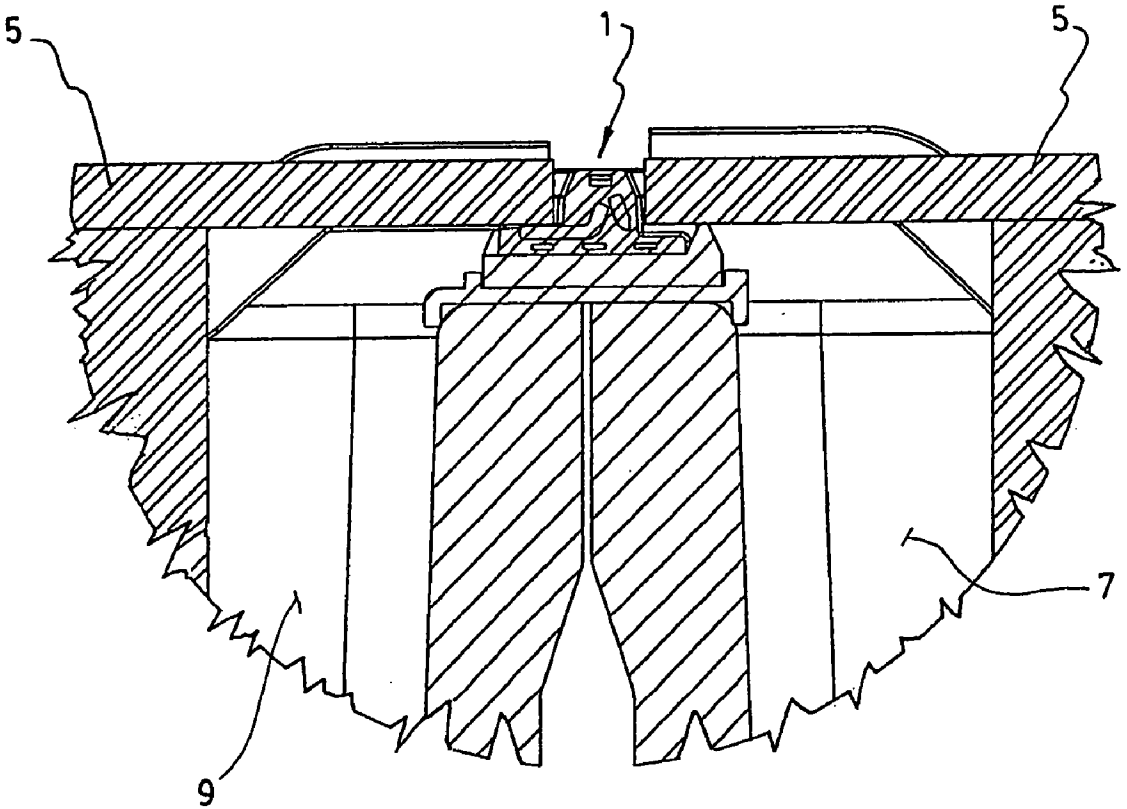
FIG. 6 is a cross-sectional view of the walls of two adjacent electrolytic cells equipped with an improved capping board as shown in FIGS. 1 to 5, said capping board being shown supporting the hanging legs of two cathodes.
Figure 7:
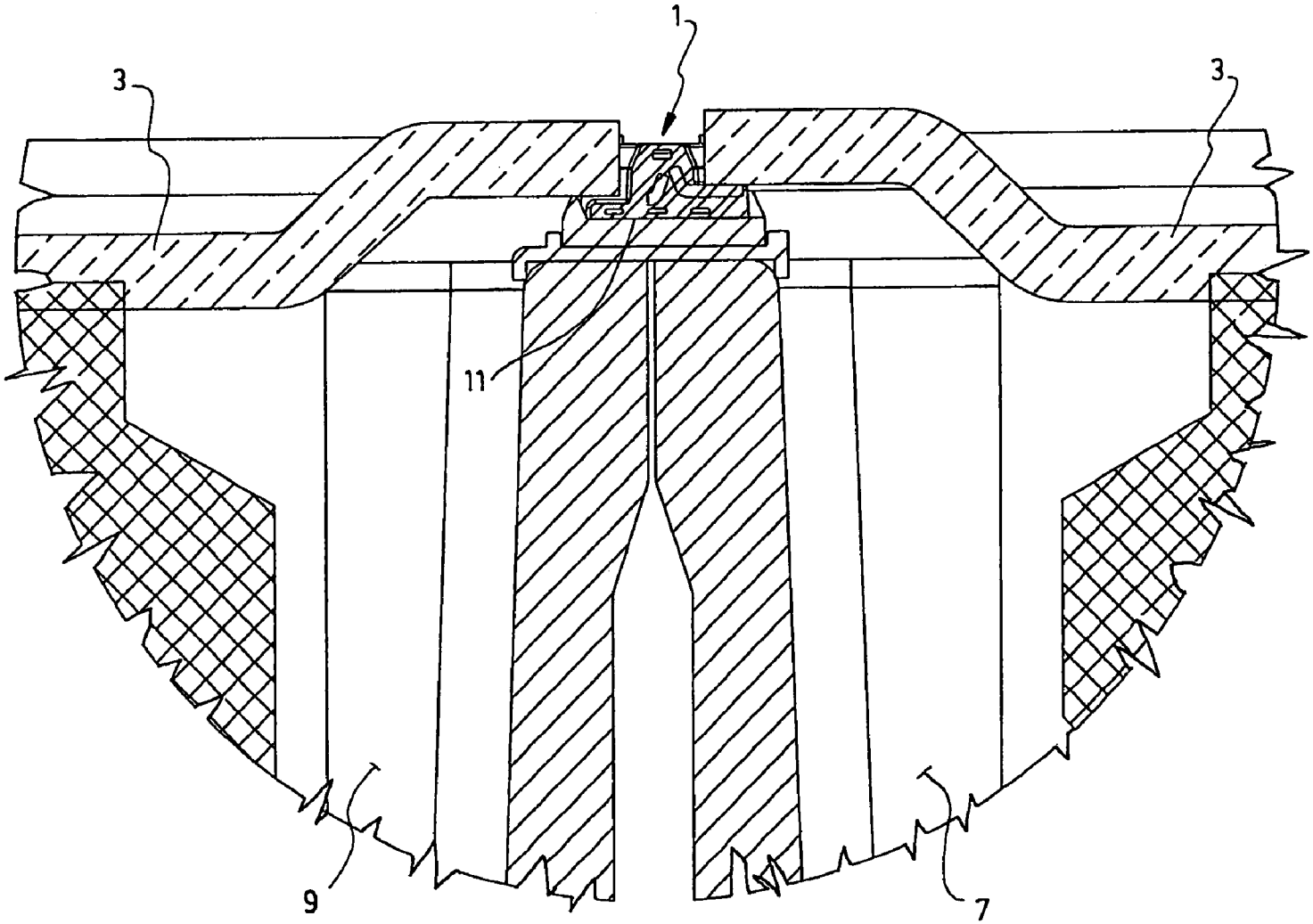
FIG. 7 is a cross-sectional view of the walls of two adjacent electrolytic cells equipped with an improved capping board as shown in FIGS. 1 to 5, said capping board being shown supporting the hanging legs of two anodes.
Figure 8:
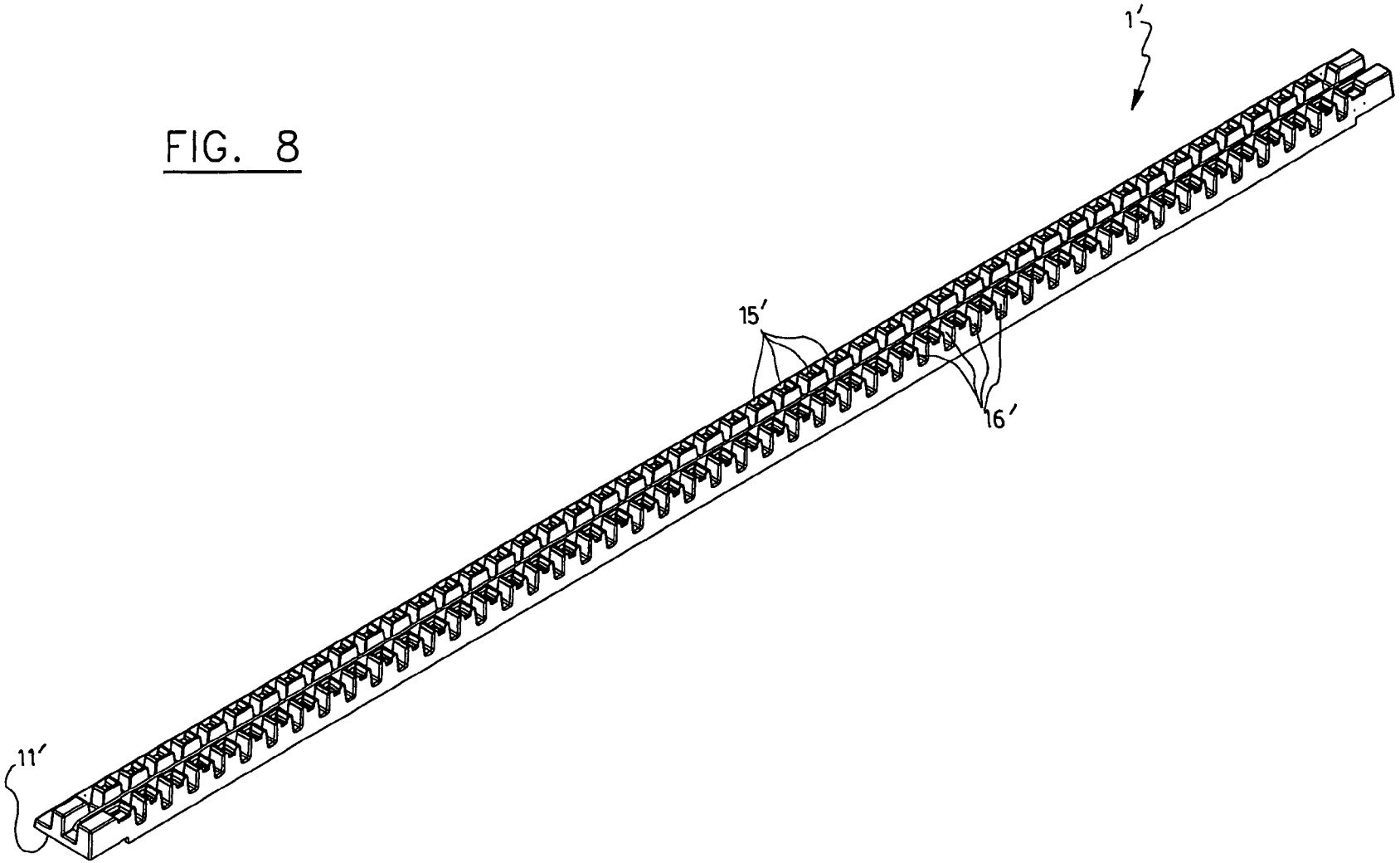
FIG. 8 is a perspective view of an improved capping board according to a second preferred embodiment of the invention.
Figure 9:
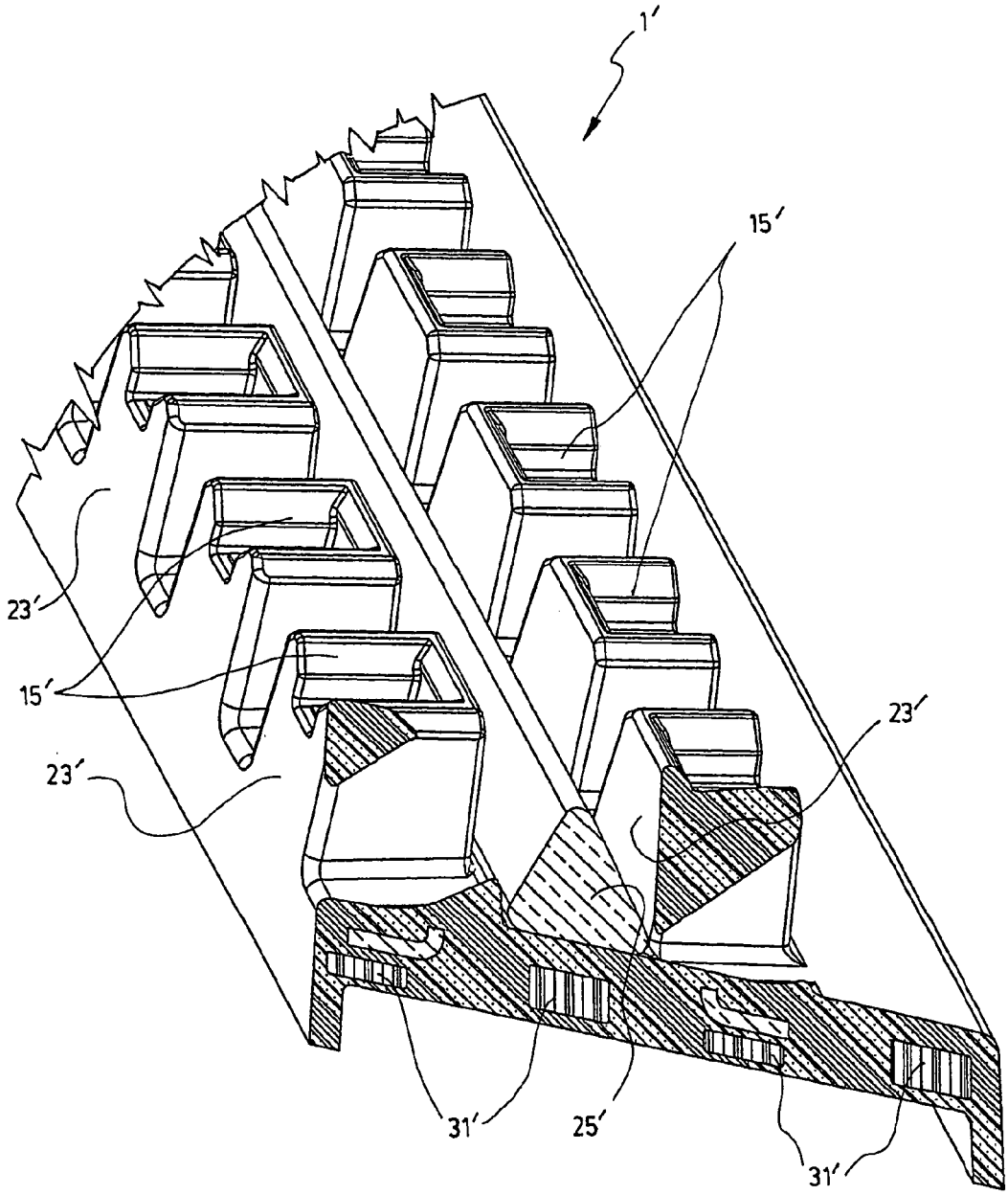
FIG. 9 is a perspective view of a portion of the improved capping board shown in FIG. 8.
Figure 10:
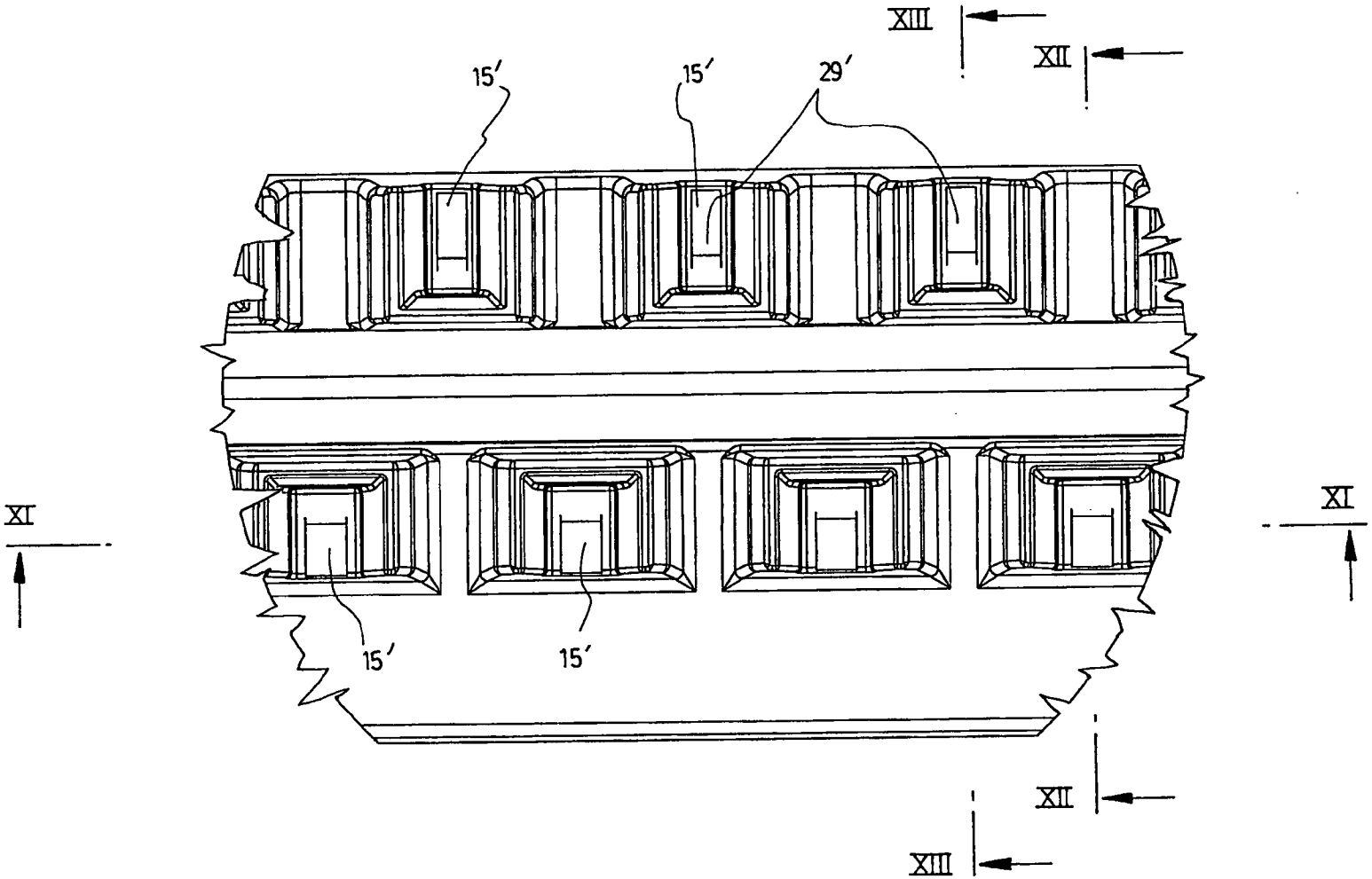
FIG. 10 is a top plan view of the portion of the improved capping board shown in FIG. 8.
Figure 11:
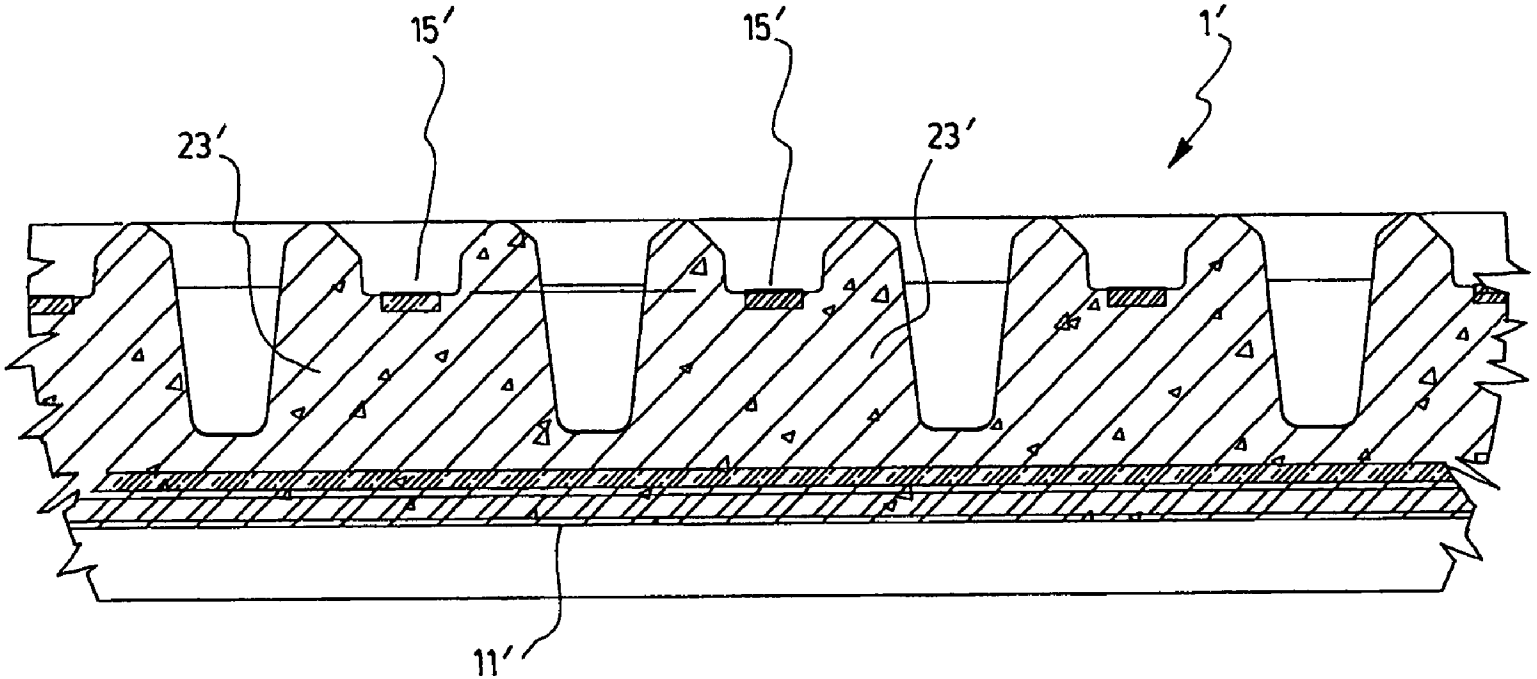
FIG. 11 is a side elevational, cross-sectional view of the portion of the improved capping board shown in FIG. 8, taken along line X—X in FIG. 10.

As it can be inferred from FIGS. 4 and 5, the sheets 19, 21 of conductive material have an L-shaped cross-section and are each provided with teeth. They are embedded in the capping board in such a manner that their teeth extend externally in the bottoms of the recesses forming the compartments of the alternate seats 16 to be connected to each other.

The capping board 1' according to the second preferred embodiment to the invention as shown in FIGS. 8 to 15 is also intended to be used to support the hanging legs of anodes 3 and cathodes 5 mounted within adjacent electrolytic cells 7, 9.

Like the previous one, the capping board 1' comprises a main body with a bottom surface 11' shaped to fit onto upper edges of two adjacent cells. It also comprises a top surface in which individual seats 15' are made. As is shown, the seats 15' are in the form recesses made on top of spaced-apart blocks 23' integral to and upwardly projecting from the top surface of the main body, each of the recesses forming a laterally opening compartment.

More specifically, the capping board 1' comprises a first set of spaced apart blocks 23' extending in line all over its length on one side of the main body, and a second set of spaced apart blocks 23' extending also in line all over its length at a given lateral distance from the first set of blocks.

As is shown in the drawings, FIGS. 8 to 10, 12 and 13, the two sets of blocks 23' form two rows that together define a central path in which a contact bar 25' may be positioned. As is also shown in FIGS. 8 to 10, 12 and 13 of the blocks 23' of the first set are in alternate position relative to those of the second one, whereby an anode 3 or cathode 5 having one hanging leg held within a recess made on top of one of the blocks on one side of a cell may have its opposite hanging leg that extends between to adjacent blocks of another capping board located on the other side of the cell and thus bears onto the contact bar 25' in the central path of the other capping board. Such an arrangement is shown in FIGS. 12, 13, 15 and 16.

Figure 12:
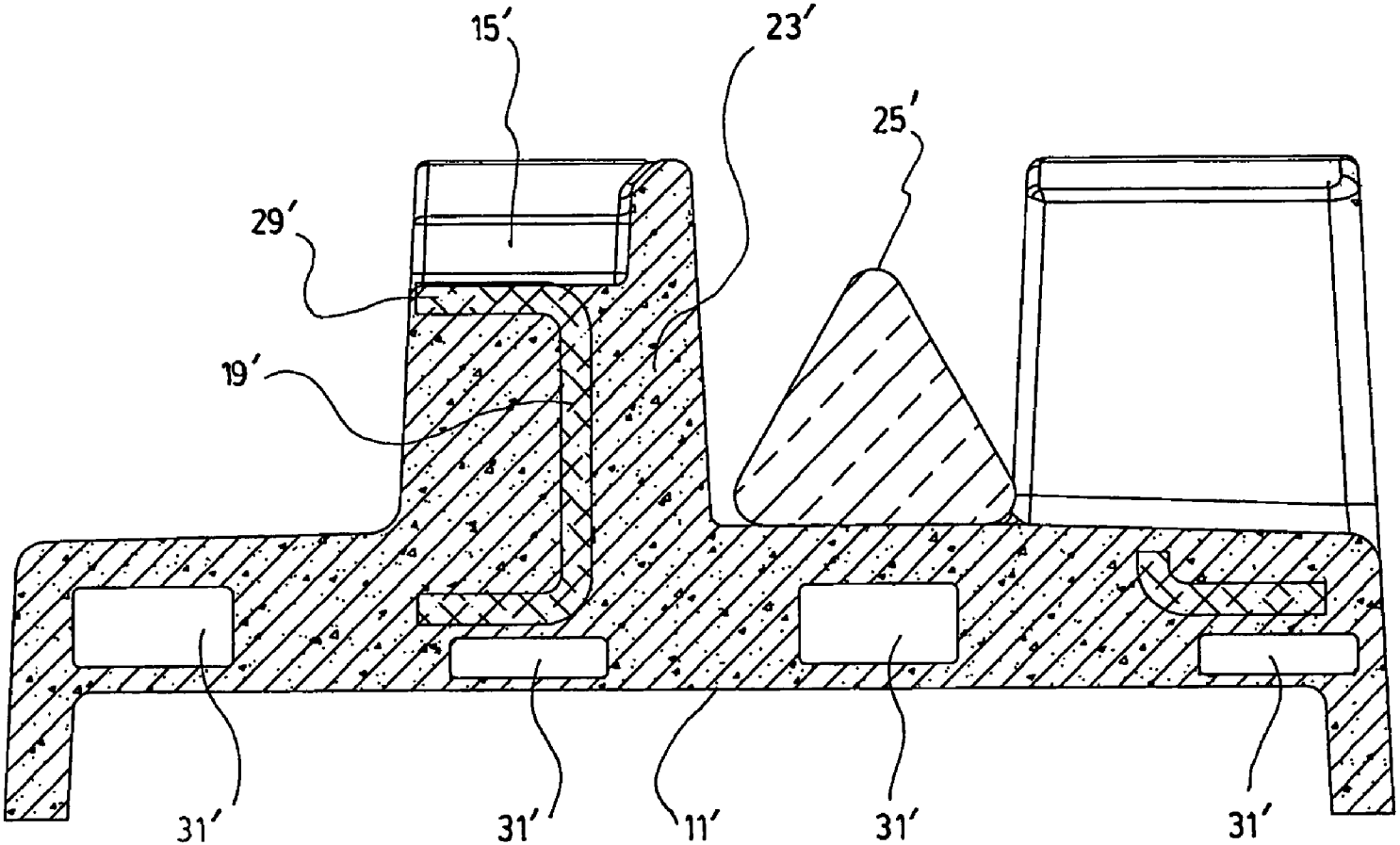
FIGS. 12 and 13 are cross-sectional views of the portion of the improved capping board shown in FIG. 8, taken along lines XII—XII and XIII—XIII, respectively, in FIG. 10.
Figure 13:
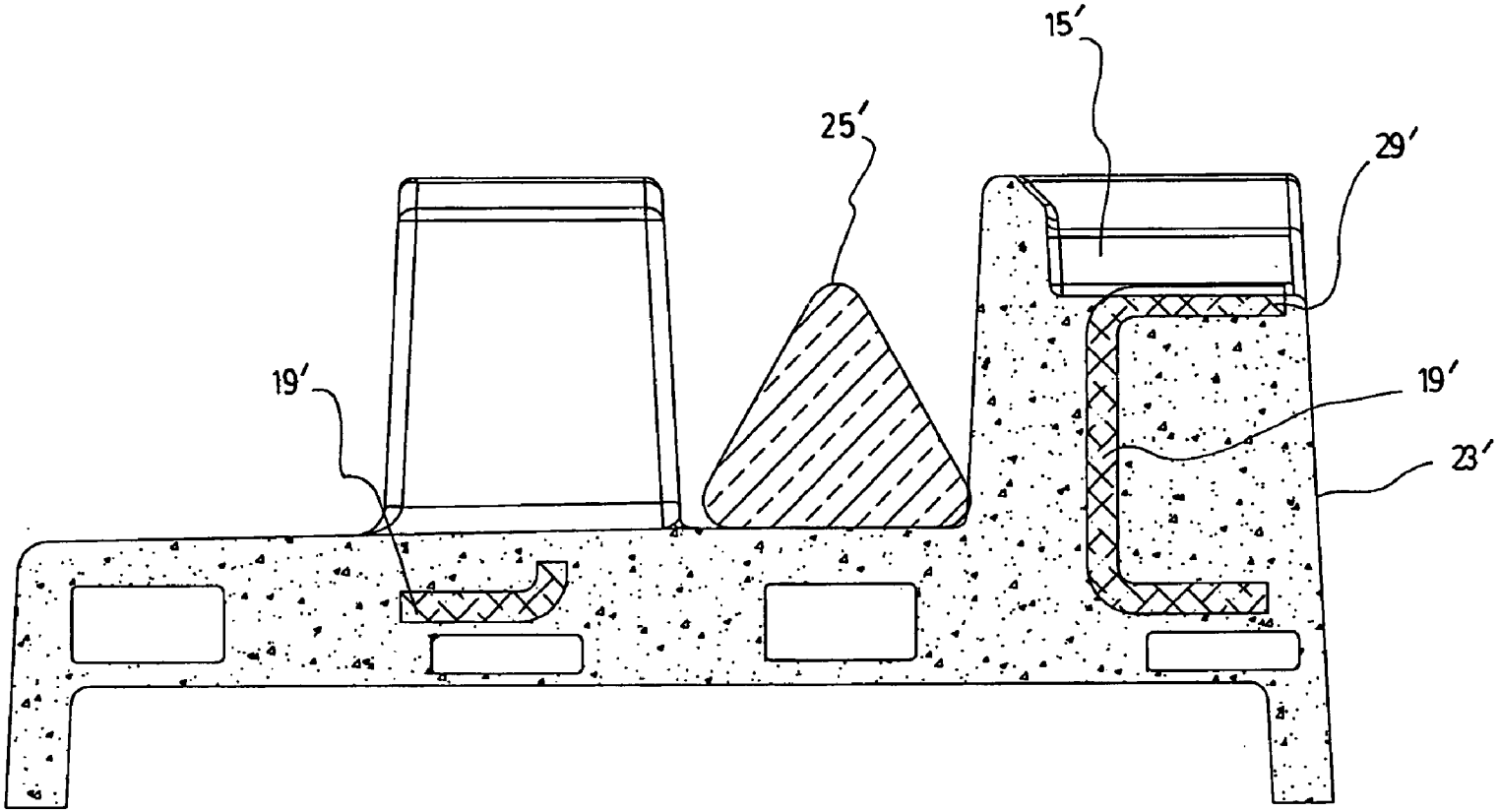
Figure 14:
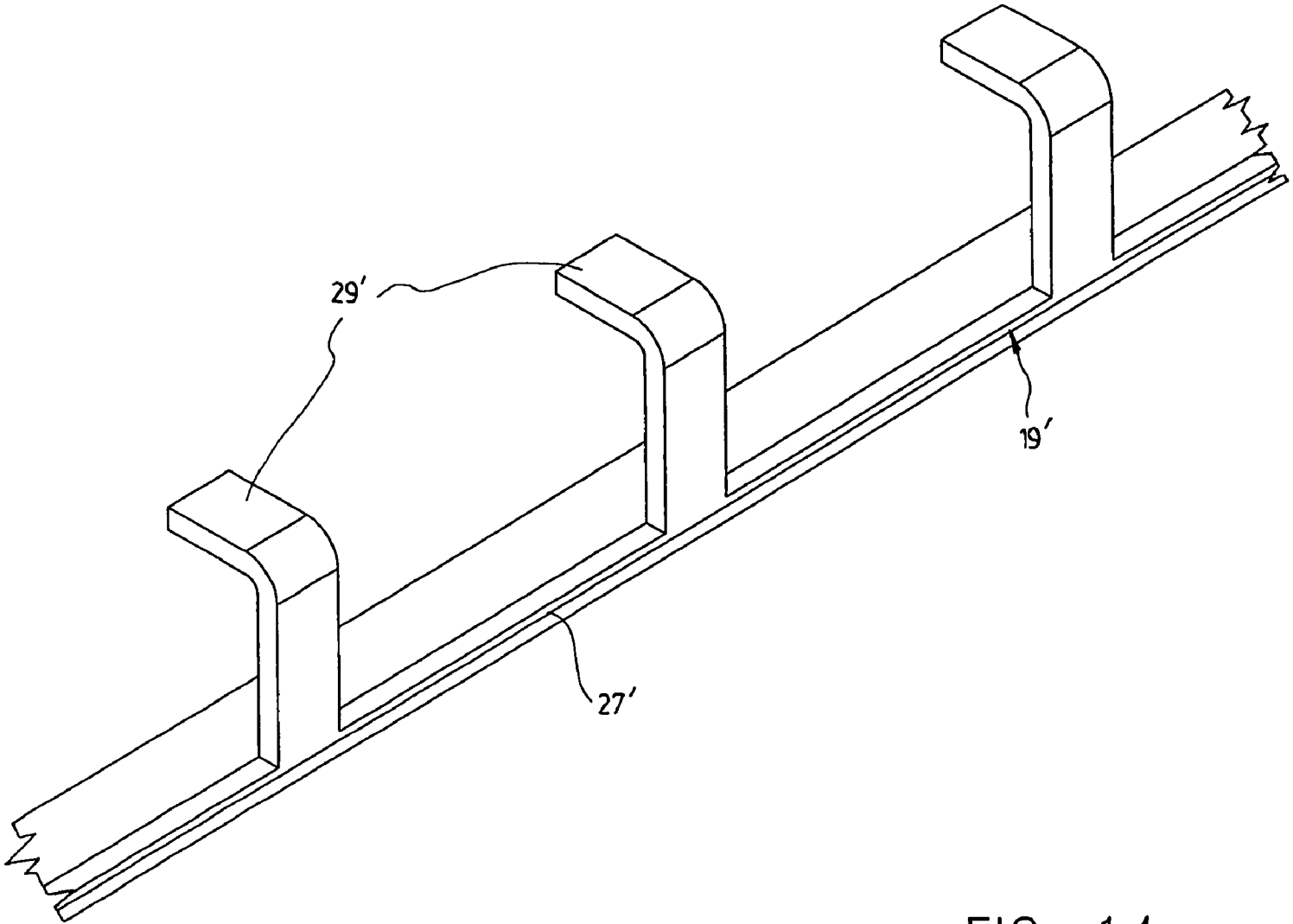
FIG. 14 is a perspective view of a section of one of the sheets of conductive material used in the improved capping board shown in FIGS. 8 to 13.
Figure 15:
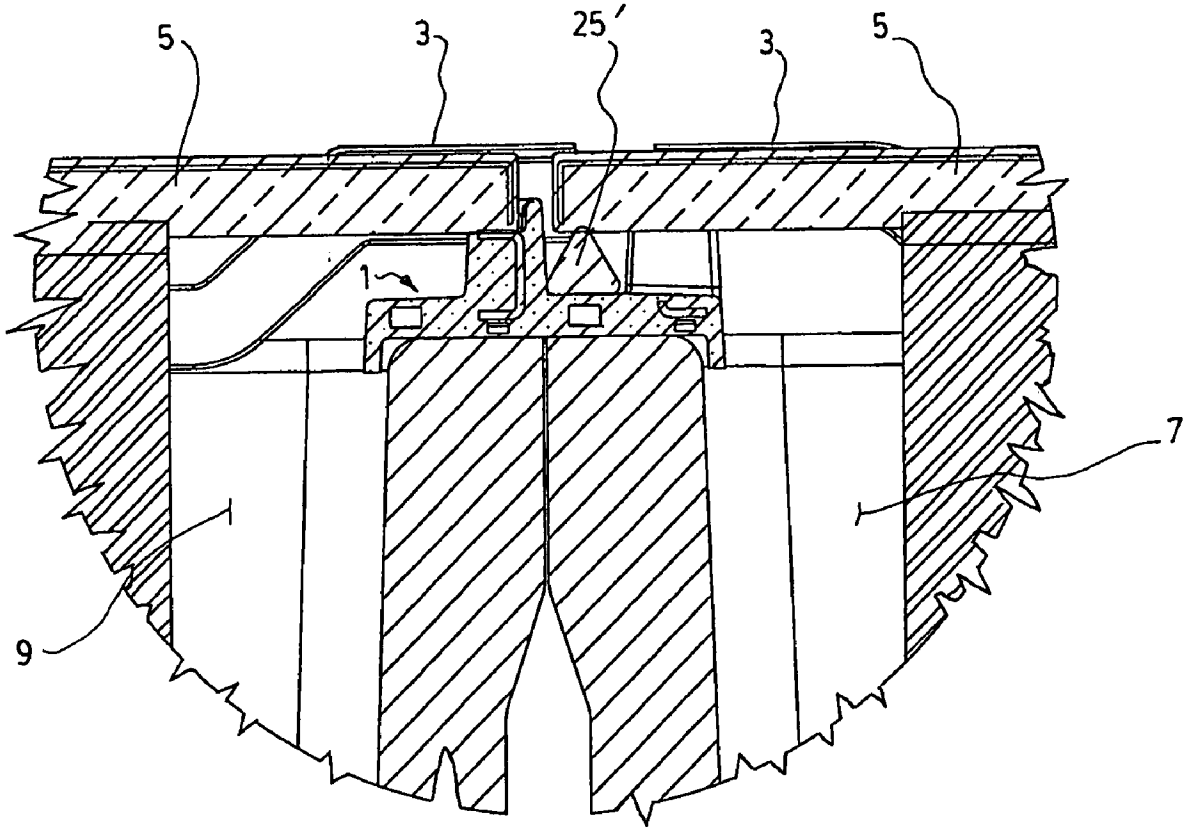
FIG. 15 is a cross-sectional view of the walls of two adjacent electrolytic cells equipped with an improved capping board as shown in FIGS. 8 to 13, said capping board being shown supporting the hanging legs of two cathodes.
Figure 16:
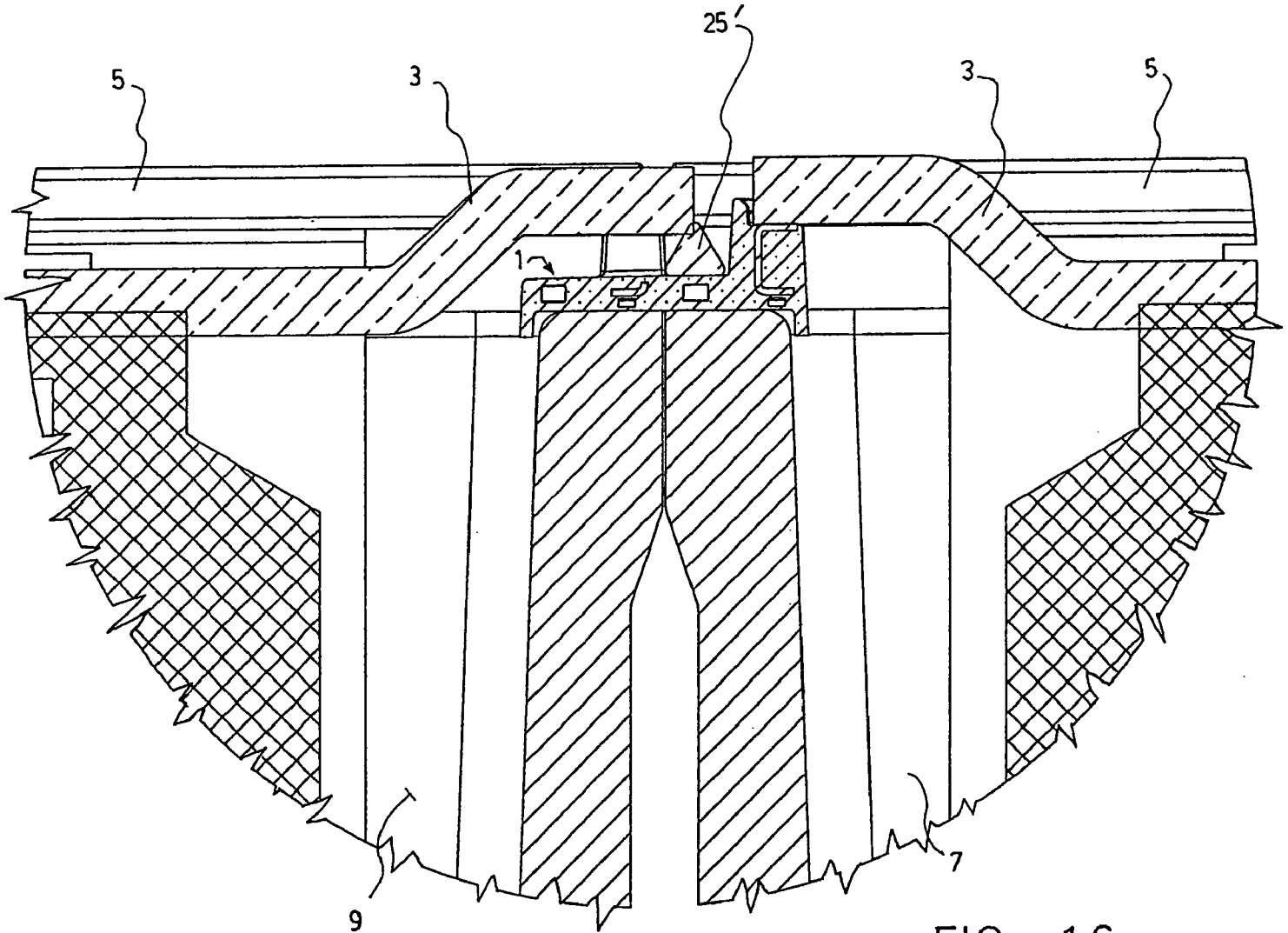
FIG. 16 is a cross-sectional view of the walls of two adjacent electrolytic cells equipped with an improved capping board as shown in FIGS. 8 to 13, said capping board being shown supporting the hanging legs of two anodes.

As shown in FIG. 14 and can be inferred from FIGS. 12 and 13, two sheets 19' of conductive material, preferably also copper, are embedded into the main body of the capping board. Each sheet 19' has a base 27' from which integrally project a plurality of L-shaped teeth 29'. Each of the teeth 29' extend into one of the blocks 23' in such a manner as to have part of it that extends externally into the recess 15' forming the compartment on top of the insulating block.

Like the capping boards disclosed in the above mentioned U.S. Pat. Nos. 4,213,842 and 5,645,701 and their Canadian counterpart Nos. 1,102,737 and 2,171,412, the capping boards 1, 1' according to the two preferred embodiments of the invention as disclosed hereinabove, are preferably made from a plastic resin selected from the group consisting of polytetrafluoroethylene, acid resistant polyester, polyvinyl ester, epoxy, polyurethane, thermoset urethane, bisphenol-epoxy A-F fumarate polyester, acrylic and methacryclic terephtalate polyester and phenolic resins, and blends of such resins, to which from 3 to 30% of glass fibres, from 2 to 10% of silica sand, from 1 to 30% mica, and from 2 to 40% of silica rock in the form of particles, have been added. Use can also be optionally made of 2 to 40% filler such as clay, talc, calcium carbonate and magnesium oxide and from 0,1 to 5% of fumed silica.

The plastic resin can be polytetrafluoroethylene. It can also be an acid-resistant polyester resin, like those sold by the firm REICHHOLD CHEMICALS LTD., under the trademarks POLYLITE 31-022 and 31-830, or by the firm ALPHA OWENS CORNING, under the trade names F-701 and T-750. It can be vinyl ester, like those sold by the firm DOW CHEMICAL, under the trademark DERAKANE, 411 series and 470 series. Any other high temperature and acid resistant epoxy resin, urethane resin or phenolic resin can also be used as single or as a blend.

In practice, use is preferably made of an acid-resistant polyester resin because this resin is less expensive in addition of being easy to handle and providing good material stability.

Advantageously, and as is also disclosed in the above mentioned U.S. and Canadian patents, the capping boards 1, 1' may also comprise at least one embedded pultruded bar 31, 31'. Each of those pultruded bars may be obtained by pultrusion of fibres selected from the group consisting of glass fibres, cizal fibres, resin fibres and carbon fibres, with a resin selected from the group consisting of polyester, vinyl ester, epoxy, polyurethane, thermoset urethane, bisphenol-epoxy A-F fumarate polyester series, acrylic and methacrylic, terephtalate polyester and phenolic resins and their mixtures, said at least one pultruded bar being further coated with a surface layer of a resin bonding agent.

Preferably, more than one pultruded bars 31, 31' are embedded into the capping board, their bars being spaced-apart and arranged in a parallel relationship over the full length of the capping board.

Preferably also, the pultruded bars 31, 31' are obtained by pultrusion of fibres selected for the group consisting of glass fibres, cizal fibres, resin fibres like Kevlar fibres and carbon fibres, with a resin selected form the group consisting of polyester, vinyl ester, epoxy, polyurethane, thermoset urethane, bisphenol-epoxy A-F fumarate polyester series, acrylic and methacrylic, terephtalate polyester and phenolic resins and their mixtures.

For obvious economical reasons, the pultruded bars 31, 31' are preferably made of continuous glass fibres or cizal fibres. Preferably also, use is made of glass fibres and of a high heat distortion isophthalic polyester, and the pultrusion is carried out with 10 to 40% by weight of a low curing polyester like the one sold by REICHHOLD under the trade name 31-022 and 50 to 85% by weight of glass fibres under a pressure of about 1200 lbs, at a temperature of 150 to 350° F. Such conditions of pultrusion cause the selected polyester resin to cure in a very fast manner.

If desired, the pultruded bars may be coated with a surface layer of a resin-bonding agent prior to being inserted into the capping board resin. Such a coating is preferably made after sanding and washing of the external surfaces of the bars in order to improve adherence. The resin bonding agent is preferably a silane like the one sold by DOW CORNING under the trade name Z-6032 or those sold by CHEMLOCK.

Any conventional casting method or compression moulding can be used for manufacturing the capping board 1, 1' according to the invention. Preferably, such a manufacture is carried out in a mould having the desired final shape of the capping board.

Depending on the type of pattern or shape of the capping board, the embedded metal sheet can be put at the beginning or during the manufacture of the board, so as to be completely embedded.

In order to facilitate extraction of the capping board after moulding, a mould-releasing agent such as for example, polyvinyl alcohol, can be used. Such releasing agent can be introduced in the resin as an additive. Alternatively, wax or an equivalent thereof can be previously spread onto the surfaces of the mould.

Before casting the capping board 1, 1', fillers and/or mica is incorporated into the resin and mixed with the same. Such is preferably carried out a few hours before using the resin. This improves the homogeneity of the resulting capping board by facilitating elimination of the air bubbles created by the introduction of the filers and/or the mica, into the resin. Advantageously, a resin-bonding agent can also be added to the resin at this stage. Once again, this bonding agent is preferably a silane like the one sold by DOW CORNING under the trade name Z-6032 or those sold by CHEMLOCK.

A catalyst may be introduced into the resin and mixed with the same just before it is used in order to accelerate hardening of the same. As catalyst, use can be made of any conventional catalyst compatible with the selected resin, such, as for example methyl ethyl ketone peroxide in an amount ranging from 0 to 2% by weight relative to the total weight of the resin.

In use, the glass fibres are impregnated with the mixture of the resin with the fillers and/or the mica, while the other additives are added. If needed, a dilution agent or solvent can be introduced in the resin to dilute the same and reduce its viscosity. Such facilitated the impregnation of the glass fibres and improves the homogeneity of the resulting capping board. Any conventional dilution agent compatible with the selected resin can be used as the solvent. The amount of solvent to be used depends on the viscosity desired for the resin. This amount preferably ranges from 0 to 10% by weight relative to the total weight of the resin.

In order to ensure complete impregnation of the glass fibres and to remove any air bubbles that may be formed therein, the glass fibres can be mechanically pressed or, when using cloth, manually folded, rolled or brushed.

After impregnation of the fibres, the capping board is shaped. To do so, the impregnated glass fibres can be pressed, folded, rolled or brushed in the mould or outside of the mould, before moulding it into the mould, until the desired final shape is obtained. During this shaping, the silica sand, the particles of silica rocks and the other additives are introduced into the resin by dusting, as the mould is filling up or, when use is made of a cloth of glass fibres, at every folding of the cloth.

During the manufacture of the capping boards 1,1', the pultruded bars 31, 31' are preferably inserted into the body of the board in such a manner as to be completely embedded in the resin and covered by a protective layer of from 0.005 to 1 inch in order to avoid direct contact between the embedded bars, the electrodes made of metal to be refined and the electrolyte used in the cell.

The number and the shape of the pultruded filling bars that must be used in depend on the thickness of the desired capping board. Preferably, the dimensions of the bars will be about (0.1 or 0.75)×(0.1 to 1)×(30 to 320) inches. Such bars are preferably spaced apart and positioned in parallel, staggered position within the capping board so as to extend over the full length of the capping board.

The general shape and size of the improved capping boards 1, 1' manufactured in this manner can vary within a large range, depending on the consumer's requirements. Generally, the capping boards 1 are cast in a single piece having the length of the vertical side-walls of the cells on which they lie. This length usually ranges from 10 to 28 feet depending on the size of the electrolytic cells.

The capping boards 1, 1' are also preferably cast so as to have substantially the same width as the sidewalls of the cells which width usually ranges from 3 to o 12 inches, typically form 4 to 9 inches.

The shape of the capping boards 1, 1' only depends on the consumer's requirements and the electro winning or the electrolytic refining method that is used. Thus, the number of seats 15, 16, 15' and their positioning may substantially vary according to the user's need.

As can be understood, the width of the capping boards 1, 1' according to the invention depends on the thickness of the top surfaces of the sidewalls of the cells and their height and structure are selected so that the boards may resist the combined weight of the electrodes, which may amount to several tons.

The improved capping boards 1, 1' according to the invention, like those disclosed in the above mentioned prior art references, is resistant to the chemical compounds used as electrolyte, such as sulphuric acid and chlorine. They are also capable of resisting to peak temperatures up to 230° C. or sometimes up to 260° C., which can occur in the case of a short circuit during electrolyte operation, thanks to the presence of the sheets of conductive material which allow redistribution of current and/or heat from one electrode end to another one.

In addition, they also have numerous other advantages directly associated to the use of pultruded filling bars in the place of wooden cores, as was done before, and to the use of sheets of conductive material embedded within their structure. More specifically, the use of embedded metal sheets and pultruded bars has the following advantage:

- they improve the repartition of the electric current density.
- they increase the life-span of the capping boards and thus reduce the maintenance and replacement cost for the consumers;
- they improve the final qualities of the refined metal by reducing the amount of impurities contained in the final product;
- they keep the electrodes in the right exact refining position as shrinkage is eliminated;
- they substantially reduce the risk of microscopic crackling which allow the electrolyte acid solutions to penetrate within the capping board, thereby making them non-insulation; and
- thanks to their structure and composition, they allow a betters heat transfer in the case of a short-circuit in the refining operation and prevent burning of the capping boards.

Therefore, the use of embedded metal sheets and pultruded bars has a numerous advantages, which make the improved capping boards according to the invention trouble-free for about eight to twelve years of operation.

The invention claimed is:

1. In a capping board for use to support anodes and cathodes within adjacent electrolytic cells, said capping board having a given length and comprising a plurality of individual insulating seats positioned in spaced apart relationship all along said length to receive and support hanging legs projecting from said anodes and cathodes, the improvement wherein said capping board comprises at least one sheet or wire of electrically conductive material embedded therein, said at least one sheet or wire extending over the length of the board and being shaped and positioned so that part of it extends externally within at least some of the insulating seats so as to allow electrical contact of the legs of either the anodes or the cathodes.

2. The improved capping board of claim 1, wherein said capping board comprises a main body with a bottom surface shaped fit onto upper edges of two of said adjacent cells, and a top surface in which said individual seats are made, said seats being in the form of recesses each forming a laterally opening compartment separated from the adjacent one by means of a vertical partition.

3. The improved capping board of claim 2, wherein said capping board comprises a plurality of said adjacent compartments that extend in rows over all its length on both sides of the main body and wherein the conductive material embedded into said capping board is in the form of two sheets, one of said sheets connecting every other of said insulating seats formed by the compartments located on one side of the main body, the other one of said sheets connecting every other of said insulating seats formed by the compartments located on the other side of the main body.

4. The improved capping board of claim 3, wherein the recesses forming the adjacent compartments on each side of the main body are of two different depths, each recess having one of said depths being adjacent to a recess having the other one of said depths.

5. The improved capping board of claim 4, wherein each of said at least one sheet of conductive material is of L-shaped cross-section and provided with teeth and is embedded in the capping board in such a manner that its teeth extend externally in the bottoms of the recesses forming the compartments of every other insulating seats to be connected to each other.

6. The improved capping board of claim 5, wherein each of said at least one sheet or wire of conductive material is made of copper.

7. The improved capping board of claim 6, wherein said board is made from a plastic resin selected from the group consisting of polytetrafluoroethylene, acid resistant polyester, polyvinyl ester, epoxy, polyurethane, thermoset polyurethane and phenolic resins and blends thereof, and contains from 3 to 30% by weight of glass fibres, from 2 to 10% by weight of silica sand, from 1 to 30% by weight of mica, from 2 to 60% by weight of silica rocks, optionally from 2 to 40% a filler selected from the group consisting of clay, talc, calcium carbonate and magnesium oxide and optionally from 0.1 to 5% of fumed silica.

8. The improved capping board of claim 7, wherein said board also comprises at least one embedded pultruded bar, each of said at least one pultruded bar being obtained by pultrusion of fibres selected from the group consisting of glass fibres, cizal fibres, resins fibres and carbon fibres, with a resin selected from the group consisting of polyester, polyvinyl ester, epoxy, polyurethane, thermoset urethane, bisphenol-epoxy A-F fumarate polyester series, acryclic and methacrylic, terephtalate polyester and their mixtures, said at least one pultruded bar being further coated with a surface layer of a resin bonding agent.

9. The improved capping board of claim 1, wherein said capping board comprises a main body with a bottom surface shaped to fit onto upper edges of two of said adjacent cells and a top surface in which said individual seats are made, said seats being in the form recesses made on top of spaced-apart insulating blocks integral to and upwardly projecting from the top surface of the main body, each of said recesses forming a laterally opening compartment.

10. The improved capping board of claim 9, wherein said capping board comprises a first set of said spaced part insulating blocks extending in line all over its length on one side of the main body, and a second set of said spaced apart insulating blocks extending also in line all over its length at a given lateral distance from the first set of blocks, said two sets of blocks forming two rows that together define a central path in which a contact bar may be positioned.

11. The improved capping board of claim 10, wherein the insulating blocks of the first set are in alternate position relative to those of the second one, whereby an anode or cathode having one leg held within a recess made on top of one of said insulating blocks on one side of a cell may have its opposite leg that extends between to adjacent insulating blocks of another capping board located on the other side of the cell and thus bears onto the contact bar in the central path of said other capping board.

12. The improved capping board of claim 11, wherein the conductive material embedded into said capping board is in the form of a sheet and each of said at least one sheet of conductive material comprises a base from which integrally project a plurality of L-shaped teeth, each of said teeth extends into one of said insulating blocks in such a manner as to have part of it that extends externally into the recess forming the compartment on top of said one block.

13. The improved capping board of claim 12, wherein each of said at least one sheet of conductive material is made of copper.

14. The improved capping board of claim 13, wherein said board is made from a plastic resin selected from the group consisting of polytetrafluoroethylene, acid resistant polyester, polyvinyl ester, epoxy, polyurethane, thermoset polyurethane and phenolic resins and blends thereof, and contains from 3 to 30% by weight of glass fibres, from 2 to 10% by weight of silica sand, from 1 to 30% by weight of mica, from 2 to 60% by weight of silica rocks, optionally from 2 to 40% a filler selected from the group consisting of clay, talc, calcium carbonate and magnesium oxide and optionally from 0.1 to 5% of fumed silica.

15. The improved capping board of claim 14, wherein said board also comprises at least one embedded pultruded bar, each of said at least one pultruded bar being obtained by pultrusion of fibres selected from the group consisting of glass fibres, cizal fibres, resins fibres and carbon fibres, with a resin selected from the group consisting of polyester, polyvinyl ester, epoxy, polyurethane, thermoset urethane, bisphenol-epoxy A-F fumarate polyester series, acrylic and methacrylic, terephtalate polyester and phenolic resins and their mixtures, said at least one pultruded bar being further coated with a surface layer of a resin bonding agent.

16. The improved capping board of claim 1, wherein said board is made from a plastic resin selected from the group consisting of polytetrafluoroethylene, acid resistant polyester, polyvinyl ester, epoxy, polyurethane, thermoset polyurethane and phenolic resins and blends thereof, and contains from 3 to 30% by weight of glass fibres, from 2 to 10% by weight of silica sand, from 1 to 30% by weight of mica, from 2 to 60% by weight of silica rocks, optionally from 2 to 40% a filler selected from the group consisting of clay, talc, calcium carbonate and magnesium oxide and optionally from 0.1 to 5% of fumed silica.

17. The improved capping board of claim 16, wherein said board also comprises at least one embedded pultruded bar, each of said at least one pultruded bar being obtained by pultrusion of fibres selected from the group consisting of glass fibres, cizal fibres, resins fibres and carbon fibres, with a resin selected from the group consisting of polyester, vinyl ester, epoxy, polyurethane, thermoset urethane, bisphenol-epoxy A-F fumarate polyester series, acrylic and methacrylic, teerephtalate polyester and phenolic resins and their mixtures, said at least one pultruded bar being further coated with a surface layer of a resin bonding agent.

18. The capping board of claim 17, wherein more than one pultruded bars are embedded into said capping board, said bars being spaced-apart and arranged in a parallel relationship over the full length of said capping board.

19. A capping board according to claim 18, wherein the glass fibres of the capping board are in the form of a woven cloth or a pressed mat previously impregnated with said resin and mica, said cloth or mat being folded, rolled or brushed in layers so as to obtain the desired final shape and being re-impregnated with said resin and dusted with said silica sand and silica rocks during the folding, rolling or brushing process to ensure good adhesion between the layers.

* * * * *